US007292199B2

(12) United States Patent
Horii

(10) Patent No.: US 7,292,199 B2
(45) Date of Patent: Nov. 6, 2007

(54) ANTENNA APPARATUS

(75) Inventor: Shotaro Horii, Kobe (JP)

(73) Assignee: Dx Antenna Company Limited, Kobe (JP)

( * ) Notice: Subject to any disclaimer, the term of this patent is extended or adjusted under 35 U.S.C. 154(b) by 50 days.

(21) Appl. No.: 11/402,810

(22) Filed: Apr. 13, 2006

(65) Prior Publication Data

US 2006/0284781 A1 Dec. 21, 2006

(30) Foreign Application Priority Data

Jun. 21, 2005 (JP) ..... 2005-180674
Dec. 12, 2005 (JP) ..... 2005-357364

(51) Int. Cl.
*H01Q 9/28* (2006.01)
*H01Q 21/12* (2006.01)
*H01Q 21/00* (2006.01)

(52) U.S. Cl. ..... 343/795; 343/812; 343/817

(58) Field of Classification Search ..... 343/795, 343/810, 812, 817, 850
See application file for complete search history.

(56) References Cited

U.S. PATENT DOCUMENTS 5,274,391 A * 12/1993 Connolly ..... 343/820
6,606,067 B2 * 8/2003 Oh et al. ..... 343/741
6,859,182 B2 * 2/2005 Horii ..... 343/727

FOREIGN PATENT DOCUMENTS

JP 2003-8328 A 1/2003

* cited by examiner

*Primary Examiner*—Shih-Chao Chen
(74) *Attorney, Agent, or Firm*—Birch, Stewart, Kolasch & Birch, LLP

(57) ABSTRACT

A radiator includes two radiating elements having a shape symmetrical with respect to an axis, and a transmission line portion connecting the tip end portions of these two radiating elements to each other. The radiating element has at least part of outer shape formed such that its distance from the axis increases with increasing distance from a midpoint of a line segment joining feed points to each other along the axis. Two radiator having such a shape are arranged along the receiving direction of electric waves and are fed with a phase difference, thereby realizing a miniaturized high-performance antenna apparatus.

14 Claims, 15 Drawing Sheets

ANTENNA APPARATUS

This nonprovisional application is based on Japanese Patent Applications Nos. 2005-180674 and 2005-357364 filed with the Japan Patent Office on Jun. 21, 2005 and Dec. 12, 2005, respectively, the entire contents of which are hereby incorporated by reference.

BACKGROUND OF THE INVENTION

1. Field of the Invention

The present invention relates to an antenna apparatus, and more particularly to a miniaturized, high-performance antenna apparatus.

2. Description of the Background Art

Yagi antenna is generally used as an antenna receiving electric waves for television broadcasting in UHF (Ultra High Frequency) band or VHF (Very High Frequency) band. Yagi antenna includes one radiator, at least one reflector, and at least one director.

Although Yagi antenna is characterized by its excellent directivity, it is increased in size when the characteristics such as gain or front-to-back ratio (F/B ratio) are to be improved. Therefore, a variety of miniature and high-performance antennas have been proposed so far. For example, Japanese Patent Laying-Open No. 2003-8328 discloses a miniature antenna that allows the front-to-back ratio to be improved.

FIG. 20 shows an exemplary conventional miniature antenna. Referring to FIG. 20, an antenna apparatus 100 has a configuration such that a housing 102 contains radiators 103, 104 for UHF-band antenna, and a VHF-band antenna 106. VHF-band antenna 106 includes two radiators 106A and two radiators 106B.

Antenna apparatus 100 further includes a director 116 and a reflector 118. Radiators 103, 104, director 116, and reflector 118 constitute a UHF-band antenna. It is noted that a feed point of each of radiators 103, 104 is connected to a 2-way divider 122, and a feed point of each of radiators 106A, 106B is connected to a 2-way divider 112.

The tip end of radiator 103 is bent toward the director 116 side, and the tip end of radiator 104 is bent toward the reflector 118 side. In this way, radiators 103, 104 have bending portions to allow electric waves at a desired center frequency to be received and also allow miniaturization. Radiator 103 has a straight portion having a length of about 80 mm and a bending portion having a length of about 20 mm. Furthermore, radiator 104 has a straight portion having a length of about 110 mm and a bending portion having a length of about 40 mm. The distance between two radiators 103 is about 15 mm, and the distance between two radiators 104 is about 20 mm. The distance between radiator 103 and radiator 104 is about 90 mm.

The dimensions of the other parts of the UHF-band antenna will be described. The length of reflector 118 is about 300 mm. The distance from the most protrudent portion of reflector 118 to radiator 104 is about 40 mm. Furthermore, the distance between radiator 103 and director 116 is about 25 mm.

In antenna apparatus 100 shown in FIG. 20, the number of directors needs to be increased in order to improve the gain of the UHF-band antenna. However, if the number of directors is increased, the size of antenna apparatus 100 increases along the direction of travel of a signal S1 by electric waves. In addition, the area of reflector 118 needs to be increased in order to improve the front-to-back ratio of the UHF-band antenna. However, if the area of reflector 118 is increased, the size of antenna apparatus 100 is also increased.

As described above, the conventional antenna apparatus inevitably increases in size if its characteristics are intended to be improved. In other words, it is difficult to miniaturize the conventional antenna while its performance is maintained.

SUMMARY OF THE INVENTION

An object of the present invention is to provide a miniature and high-performance antenna apparatus.

In summary, in accordance with the present invention, an antenna apparatus includes first and second radiators arranged in parallel along a prescribed direction. Each of the first and second radiators includes a first radiating element and a second radiating element arranged symmetrically to the first radiating element with respect to a first axis along the prescribed direction. The first and second radiating elements are provided in such a manner that a midpoint of a line segment extending between a feed point of the first radiating element and a feed point of the second radiating element is positioned on the first axis, and each of the first radiating element and the second radiating element has at least part of an outer shape formed such that a distance from the first axis to the part increases as a distance from the midpoint along the first axis increases. The first and second radiating elements each further include a first transmission line portion provided on one side of opposing sides with respect to a second axis overlapping the line segment to connect tip end portions of the first and second radiating elements to each other.

Preferably, the first and second radiating elements each have a shape symmetrical with respect to the second axis. The first and second radiating elements each further include a second transmission line portion provided on a side opposite to the first transmission line portion with respect to the second axis to connect tip end portions of the first and second radiating elements to each other.

More preferably, the first and second radiating elements each have a shape of a polygon. The polygon is symmetrical with respect to the second axis and has first and second sides formed such that a distance from the first axis to first side and a distance from the first axis to second side increase as a distance from the midpoint along the first axis increases.

Further preferably, the polygon is a pentagon further having third, fourth and fifth sides. The third and fourth sides are parallel to the second axis. One end of the third side is connected to the first side. One end of the fourth side is connected to the second side. One end and the other end of the fifth side are connected to the other end of the third side and the other end of the fourth side, respectively.

More preferably, the first and second radiating elements and the first and second transmission line portions each are formed such that a distance from a plane including the first and second axes increases as a distance from the midpoint along the first axis increases.

More preferably, the first and second radiating elements and the first and second transmission line portions are integrally formed like a plate.

Preferably, the antenna apparatus further includes a feed portion. The feed portion feeds each of the first and second radiators such that first and second output signals respectively output from the first and second radiators have a same phase, in response to receiving electric waves traveling along the prescribed direction.

More preferably, the antenna apparatus further includes at least one of a director and a reflector.

More preferably, the feed portion includes a first feed line and a second feed line. The first feed line connects the first radiating element included in the first radiator to the second radiating element included in the second radiator. The second feed line connects the second radiating element included in the first radiator to the first radiating element included in the second radiator. The length of each of the first and second feed lines is determined according to a phase difference between the first and second output signals.

More preferably, the feed portion includes a combination portion and an amplification portion. The combination portion corrects a phase difference between the first and second output signals to combine the first and second output signals. The amplification portion amplifies an output from the combination portion.

Further preferably, the amplification portion can switch whether or not the output from the combination portion is amplified.

More preferably, the feed portion includes an amplification portion and a combination portion. The amplification portion amplifies the first and second output signals. The combination portion corrects a phase difference between the first and second output signals amplified by the amplification portion to combine the first and second output signals.

Further preferably, the amplification portion can switch whether or not the first and second output signals are amplified.

More preferably, the antenna apparatus further includes a housing accommodating the first and second radiators.

A main advantage of the present invention is in that two radiators are included that are provided in a reception/transmission direction of electric waves and formed such that at least part of their outer shape broadens along the direction vertical to the above-noted direction, thereby realizing a miniaturized high-performance antenna apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
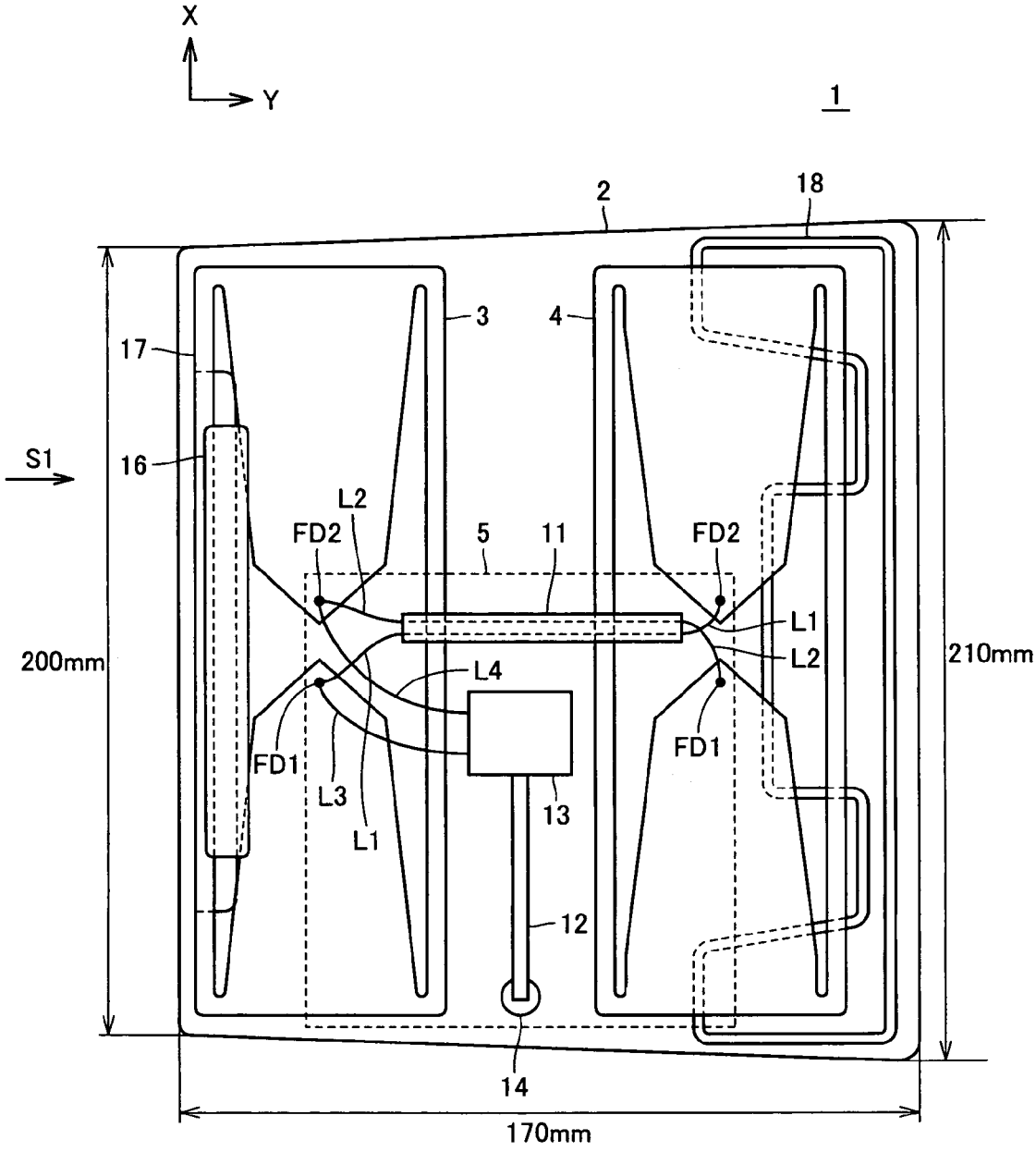
FIG. 1 is a schematic plan view showing an overall configuration of an antenna apparatus in accordance with the present invention.

In the following, the embodiments of the present invention will be described in detail with reference to the figures. It is noted that in the figures, the same or corresponding parts will be denoted with the same reference characters.

First Embodiment

FIG. 1 is a schematic plan view showing an overall configuration of an antenna apparatus in accordance with the present invention. Referring to FIG. 1, an antenna apparatus 1 includes a housing 2, and radiators 3, 4 accommodated in housing 2 and arranged in parallel along a prescribed direction. When antenna apparatus 1 is installed outdoors, radiators 3, 4 are protected from the wind and the rain by housing 2, thereby preventing degradation in characteristics. It is noted that "prescribed direction" refers to the Y-axis (the first axis) direction in FIG. 1. The Y-axis direction corresponds to the direction of travel of a signal S1 (electric waves). Radiators 3, 4 each have feed points FD1, FD2.

Antenna apparatus 1 further includes a feed portion 5 for feeding radiators 3, 4. When signal S1 travels from radiator 3 to radiator 4, radiator 4 receives signal S1 after radiator 3. A phase difference arises between a signal output from radiator 3 in response to receiving signal S1 and a signal output from radiator 4 in response to receiving signal S1. Feed portion 5 corrects the phase difference to combine the signals such that the signals output from radiators 3, 4 have the same phase. In short, feed portion 5 feeds radiators 3, 4 with a phase difference. The characteristics of antenna apparatus 1 is improved by feeding radiators 3, 4 with a phase difference.

Feed portion 5 includes a feeder line 11, a coaxial cable 12, a balun 13, and a connector 14. Feeder line 11 includes transmission lines L1, L2. Transmission line L1 connects feed point FD1 of radiator 3 and feed point FD2 of radiator 4 to each other. Transmission line L2 connects feed point FD2 of radiator 3 and feed point FD1 of radiator 4 to each other. Transmission lines L1, L2 are provided to cross each other at the radiator 4 side.

The reason why transmission lines L1, L2 are crossed is that an output from radiator 3 and an output from radiator 4 are combined at the same phase. The length of feeder line 11 is determined to be suitable for correction of the phase difference between the signal output from radiator 3 and the signal output from radiator 4. Specifically, for example, if the distance between radiators 3 and 4 is about 98 mm (about 0.2λ of the center frequency (620 MHz) of the receiving frequency band) and the impedance of feeder line 11 is 300Ω, the length of feeder line 11 is set at 135 mm (about 0.3λ of the center frequency).

Balun 13 is used to convert unbalanced feed by coaxial cable 12 into balanced feed by transmission lines L3, L4 (and feeder line 11). An exemplary circuit of balun 13 will be described later. It is noted that the length of coaxial cable 12 is set, for example, at about 85 mm.

Connector 14 is provided to output a signal produced by combining the outputs from radiators 3, 4 to the outside. Connector 14 is, for example, an F-type connector.

Antenna apparatus 1 further includes directors 16, 17 provided corresponding to radiator 3. Provision of directors 16, 17 improves the gain of antenna apparatus 1. It is noted that directors 16, 17 may not be included in antenna apparatus 1 if a desired characteristic can be achieved only with radiators 3, 4. The number or length of directors is determined appropriately depending on the required gain of antenna apparatus 1.

Directors 16, 17 are formed of conductive plates. Director 16 has a length in the X-axis direction of about 86 mm (about 0.2λ of the center frequency) and a length in the Y-axis direction of 10 mm. Director 17 has a length in the X-axis direction of about 139 mm (about 0.3λ of the center frequency) and a length in the Y-axis direction of 10 mm. The length in the X-axis direction differs between director 16 and director 17 in order to minimize a difference between the gain in the low frequency band and the gain in the high frequency band in a wide band (for example, 470 to 770 MHz).

Antenna apparatus 1 further includes a reflector 18 provided corresponding to radiator 4. Reflector 18 is formed, for example, of a wire such as AWG-24 wire. It is possible to vary the characteristics such as gain depending on the length of the wire. It is noted that reflector 18 may not be included in antenna apparatus 1 when a desired characteristic can be achieved only with radiators 3, 4. In short, antenna apparatus 1 may be configured to include at least one of a director and a reflector.

Reflector 18 is provided below radiator 4 and is accommodated in housing 2 in such a manner as to be bent in the vicinity of the center of radiator 4. When reflector 18 is formed of a wire, even a long wire can easily be accommodated in housing 2, so that antenna apparatus 1 can be miniaturized. It is noted that reflector 18 may be formed of a conductive plate.

Reflector 18 is arranged to surround two end portions of radiator 4. Because of such a configuration of reflector 18, reflector 18 functions as a so-called corner reflector.

It is noted that the length in the Y-axis direction of housing 2 is about 170 mm. The length in the X-axis direction of housing 2 is such that the length on the reflector 3 side is about 200 mm and the length on the radiator 4 side is about 210 mm.

In the following, antenna apparatus 1 will be described as an antenna receiving electric waves in UHF band. It is noted that the antenna apparatus in accordance with the present invention is not limited to an antenna for UHF band and may receive electric waves at higher frequencies (for example, GHz band) by appropriately setting the size of each of radiators 3, 4. The antenna apparatus in accordance with the present invention is also applicable to a transmission antenna.

Figure 2:
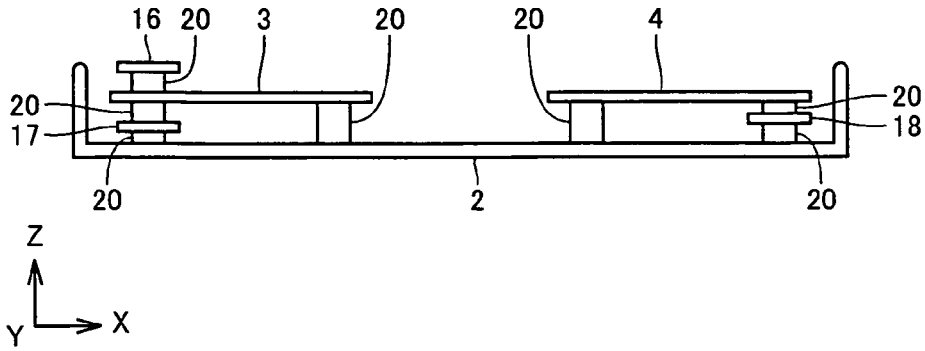
FIG. 2 is a view illustrating an arrangement of radiators 3, 4, directors 16, 17, and a reflector 18 as viewed from the side of antenna apparatus 1 in FIG. 1.

FIG. 2 is a side view schematically showing the arrangement of radiators 3, 4, directors 16, 17, and reflector 18 in FIG. 1. Referring to FIG. 2, directors 16, 17 are provided such that radiator 3 is sandwiched therebetween. Furthermore, reflector 18 is provided below radiator 4. Radiators 3, 4 and directors 16, 17 are formed of conductive plates, and reflector 18 is formed of a wire or a conductive plate. Therefore, the height of antenna apparatus 1 can be reduced. It is noted that, for example, an insulator 20 is provided between each of radiators 3, 4, directors 16, 17, reflector 18, and housing 2.

Radiators 3, 4 may be provided such that, for example, the thickness direction of each of radiators 3, 4 is along the Z-axis direction. In this case, each area of radiators 3, 4 receiving signal S1 increases, so that the characteristics of antenna apparatus 1 can be improved.

Figure 3:
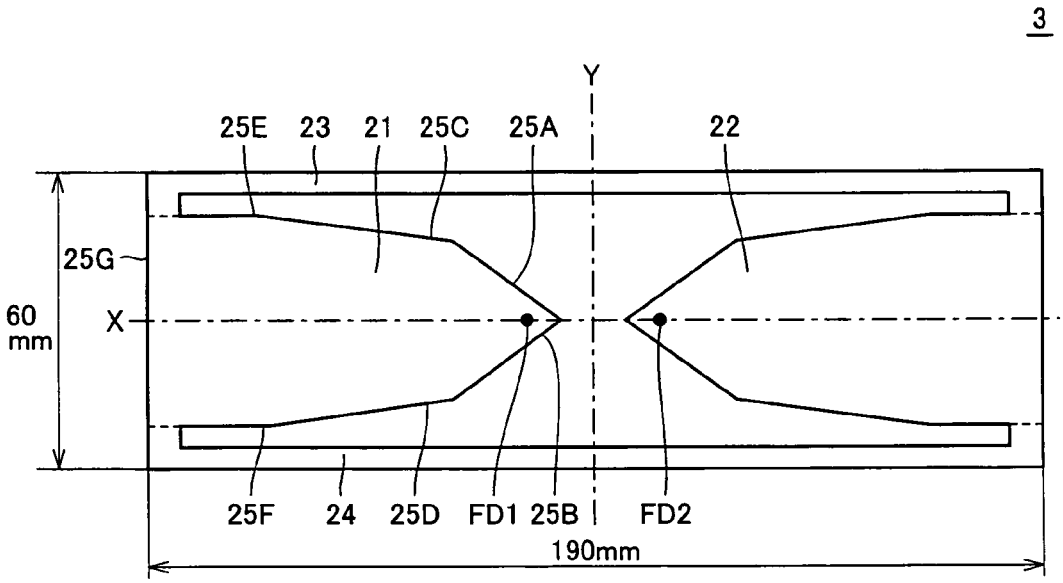
FIG. 3 is a view showing radiator 3 in FIG. 1 in detail.

FIG. 3 is a view showing radiator 3 in FIG. 1 in detail. It is noted that the shape of radiator 4 is similar to that of radiator 3, and therefore in the following the shape of radiator 3 is representatively illustrated.

Referring to FIG. 3, radiator 3 includes radiating elements 21, 22 and transmission line portions 23, 24. Radiating elements 21, 22 have feed points FD1, FD2, respectively. Radiating element 22 is arranged symmetrically to radiating element 21 with respect to the X-axis. The Y-axis in FIG. 3 is an axis along the direction of travel of signal S1 and passes through the midpoint of the line segment joining feed point FD1 and FD2. The X-axis passes through the midpoint of this line segment and is vertical to the Y-axis. In other words, the X-axis and the Y-axis shown in FIG. 3 are in the same direction with the X-axis and the Y-axis shown in FIG. 1, respectively.

Each of radiating elements 21, 22 is provided such that the middle point of the line segment joining feed point FD1 and FD2 is positioned on the Y-axis. At least part of the outer shape of each of radiating elements 21, 22 is formed such that the distance from the Y-axis increases with increasing distance from this middle point along the Y-axis.

The shape of radiating element 21 will be described representatively. Radiating element 21 is a polygon having sides 25A-25G. Side 25A and side 25B are symmetrical with respect to the X-axis, and their distance from the Y-axis increases with increasing distance from the midpoint of the line segment joining feed points FD1 and FD2 along the Y-axis. Sides 25C, 25D are formed similarly. It is noted that sides 25E, 25F are line segments parallel to the X-axis, and side 25G is a line segment parallel to the Y-axis.

It is noted that the shape of radiating element 21 may be, for example, a triangle, a trapezoid, a pentagon, and the like as long as two sides are included in radiating element 21 in such a manner that they are symmetrical with respect to the X-axis and their distance from the Y-axis increases with increasing distance from the midpoint of the line segment joining feed points FD1 and FD2 along the Y-axis.

Transmission line portion 23 is provided at one of opposing sides with respect to the X-axis and connects the tip end portions of radiating elements 21, 22 to each other. Transmission line portion 24 is provided on the side opposite to transmission line portion 23 with respect to the X-axis.

Similar to transmission line portion 23, transmission line portion 24 connects the tip end portions of radiating elements 21, 22 to each other.

It is noted that radiator 3 has a length in the X-axis direction of about 190 mm and a length in the Y-axis direction of about 60 mm.

As described above, radiator 3 includes radiating elements 21, 22 having a symmetrical shape with respect to the Y-axis, and transmission line portions 23, 24 connecting the tip end portions of radiating elements 21, 22 to each other. Radiating elements 21, 22 have at least part of their outer shape formed such that its distance from the Y-axis increases with increasing distance from the midpoint of the line segment joining feed points FD1 and FD2 along the Y-axis. Two radiators having such a shape are arranged along the receiving direction of electric waves and are fed with a phase difference, thereby realizing a miniaturized, high-performance antenna apparatus.

It is noted that in the antenna apparatus of the present invention, the shape of the radiator may be symmetrical with respect to the Y-axis. It is noted that the shape of the radiator may also be symmetrical with respect to the X-axis so that the characteristics of the antenna apparatus can further be improved.

Figure 4:
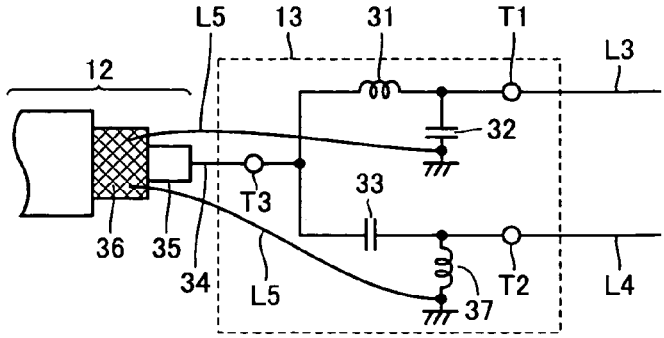
FIG. 4 shows an exemplary configuration of a balun 13 in FIG. 1.

FIG. 4 shows an exemplary configuration of balun 13 in FIG. 1. Referring to FIG. 4, balun 13 includes coils 31, 37 and capacitors 32, 33. Coil 31 is connected between a terminal T1 and a terminal T3. Capacitor 32 has one end connected to terminal T1 and the other end connected to a ground node. Capacitor 33 is connected between a terminal T2 and terminal T3. Coil 37 has one end connected to terminal T2 and the other end connected to a ground node.

Transmission lines L3, L4 shown in FIG. 1 are connected to terminals T1, T2, respectively. A core wire 34 of coaxial cable 12 is connected to terminal T3. Coaxial cable 12 is provided with an external conductor 36 on the outside of core wire 34 with an insulator 35 interposed. External conductor 36 is connected to the ground node. FIG. 4 schematically shows external conductor 36 connected to the ground node as a transmission line L5. It is noted that balun 13 may be formed using a transformer.

Figure 5:
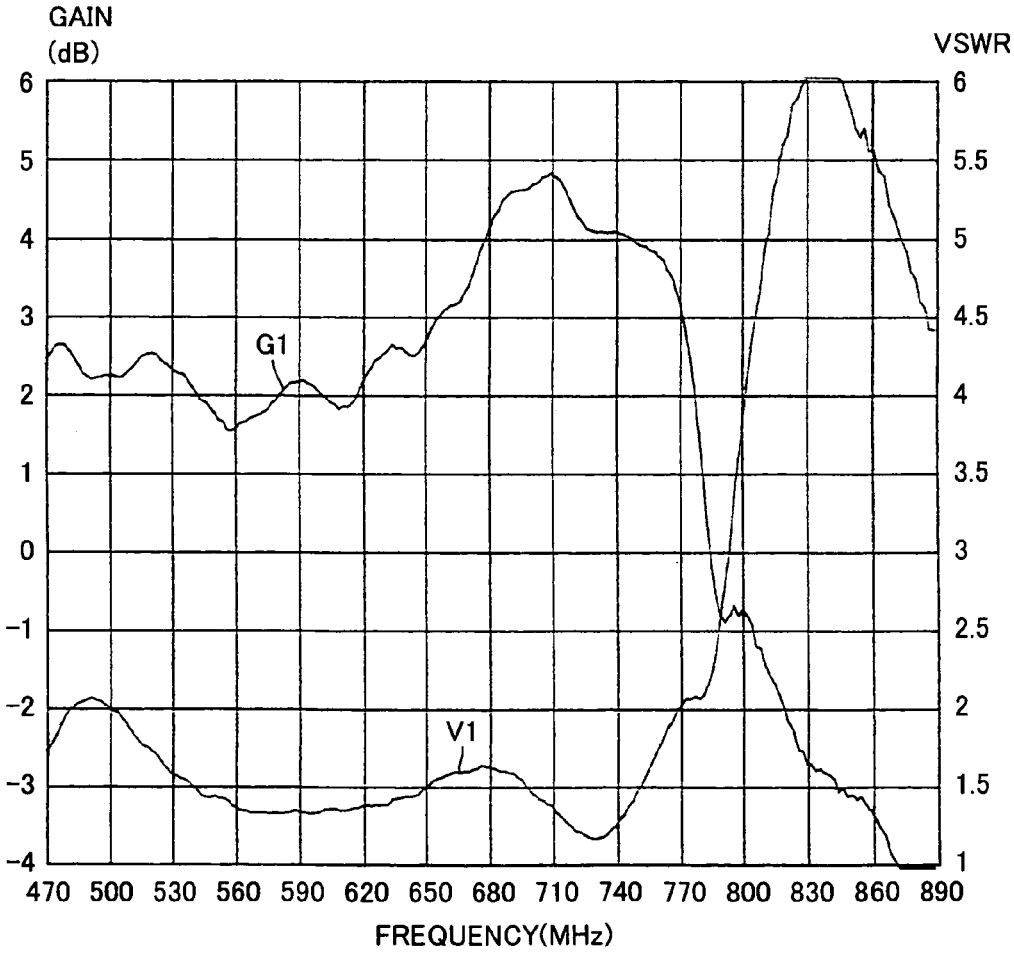
FIG. 5 is a diagram showing a characteristic of antenna apparatus 1 formed of radiators 3, 4 and a feed portion 5.

FIG. 5 is a diagram showing a characteristic of antenna apparatus 1 formed of radiators 3, 4 and feed portion 5. Referring to FIG. 5, in the graph, the axis of abscissas represents the frequency range, and the axis of ordinates represents the gain and VSWR (voltage standing wave ratio). The frequency range is 470 to 890 MHz. The frequency range of the graph in FIG. 5 includes a frequency range (470 to 770 MHz) of electric waves for broadcasting in Japanese UHF television broadcasting. A curve G1 represents the varying gain with respect to frequencies. A curve V1 represents varying VSWR with respect to frequencies. In the frequency range of 470 to 770 MHz, the gain varies in the range from about 2 dB to 5 dB, and VSWR is approximately 2 or lower.

Figure 6:
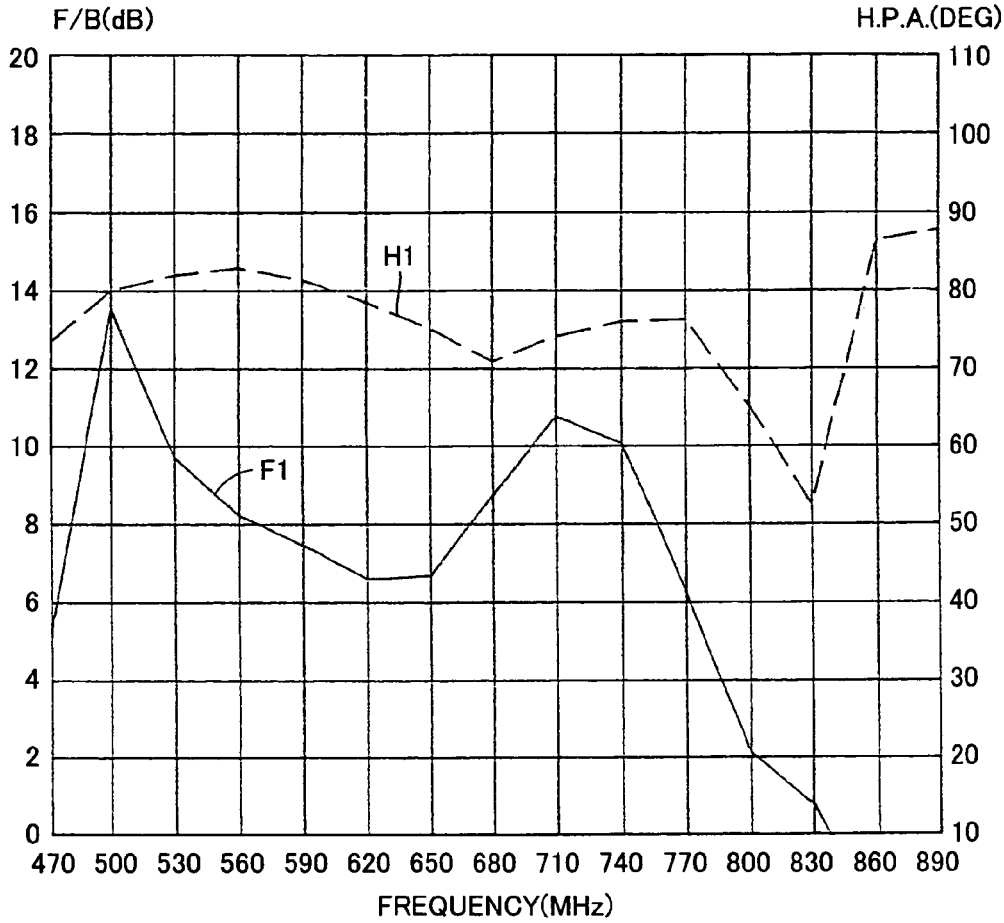
FIG. 6 is a diagram showing another characteristic of antenna apparatus 1 formed of radiators 3, 4 and feed portion 5.

FIG. 6 is a diagram showing another characteristic of antenna apparatus 1 formed of radiators 3, 4 and feed portion 5. Referring to FIG. 6, in the graph, the axis of abscissas represents the frequency range and the axis of ordinates represents front-to-back ratio (represented as F/B in FIG. 6) and half-width (represented as H.P.A in FIG. 6). A half-width refers to an angular width over which radiant intensity (radiant power) is one-half the maximum value. A front-to-back ratio refers to a ratio between the radiant intensity in the direction of the reference point (an angle of 0°) and the radiant intensity in the direction in the range of 180°±60° with respect to the direction of the reference point. A curve H1 represents the varying half-width with respect to frequencies. A curve F1 represents the varying front-to-back ratio with respect to frequencies. In the frequency range of 470 to 770 MHz, the front-to-back ratio varies from about 6 dB to 14 dB, and the half-width varies from about 70° to about 85°.

Figure 7:
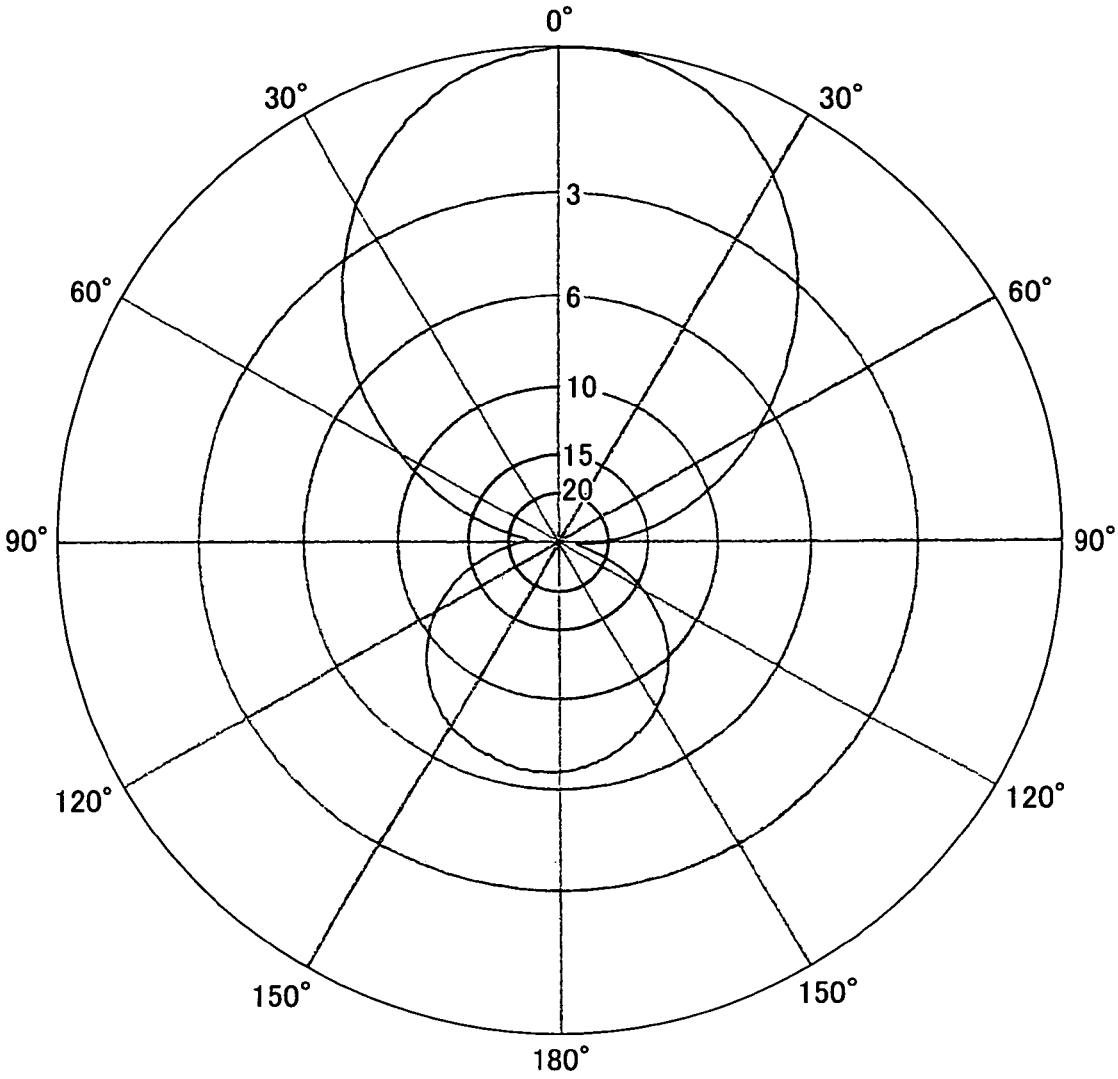
FIG. 7 is a diagram showing yet another characteristic of antenna apparatus 1 formed of radiators 3, 4 and feed portion 5.

FIG. 7 is a diagram showing yet another characteristic of antenna apparatus 1 formed of radiators 3, 4 and feed portion 5. Referring to FIG. 7, shown is the directivity of antenna apparatus 1 formed of radiators 3, 4 and feed portion 5. The center frequency of the directivity shown in FIG. 7 is 620 MHz. In this case, the front-to-back ratio is about 6.5 dB and the half-width is about 85°. High directivity occurs at the front (the radiator 3 side of radiators 3, 4 in antenna apparatus 1) of antenna apparatus 1.

Now, the characteristic of antenna apparatus 1 as described above further including directors 16, 17 and reflector 18 will be described.

Figure 8:
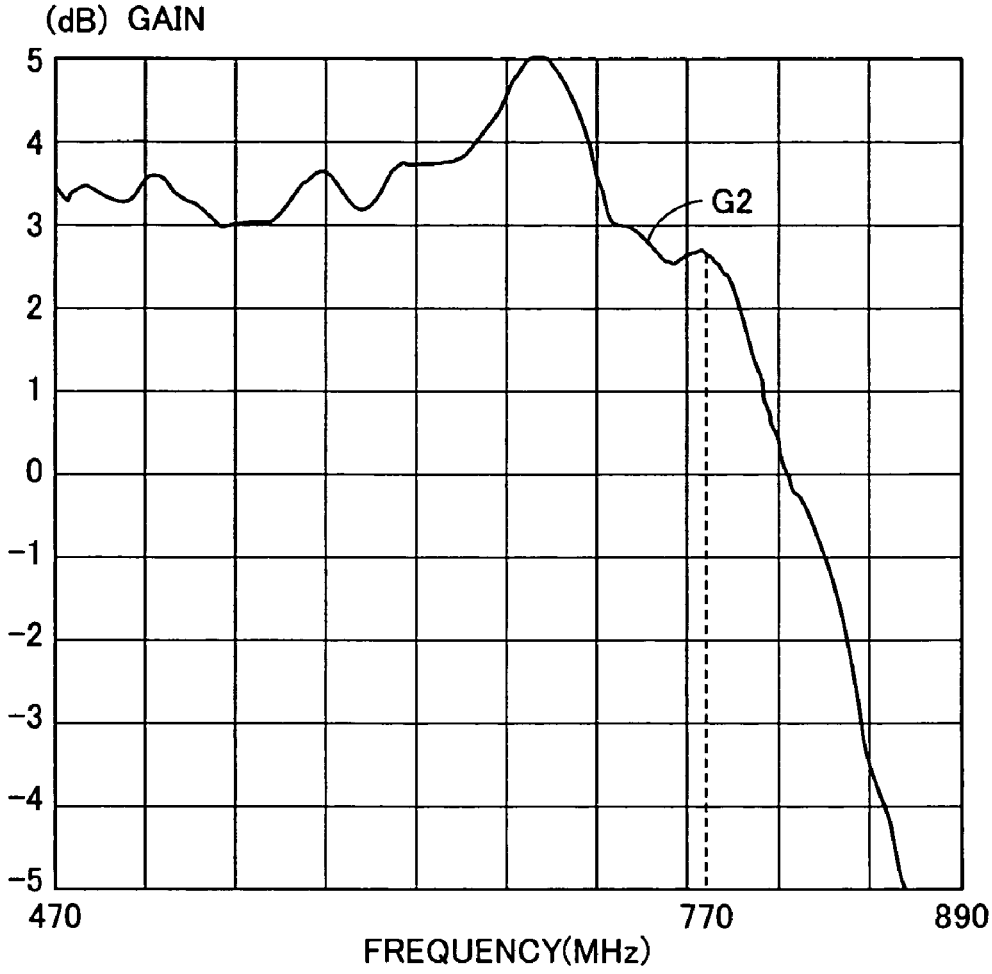
FIG. 8 is a diagram showing a characteristic of antenna apparatus 1 further including directors 16, 17 and a reflector 18.

FIG. 8 is a diagram showing a characteristic of antenna apparatus 1 further including directors 16, 17 and reflector 18. Referring to FIG. 8, a curve G2 represents the varying gain with respect to frequencies. In almost the full range of the frequency range of 470 to 770 MHz, the gain is about 3 dB or higher. Because of provision of directors 16, 17 and reflector 18, antenna apparatus 1 has a high gain in a wide band.

Figure 9:
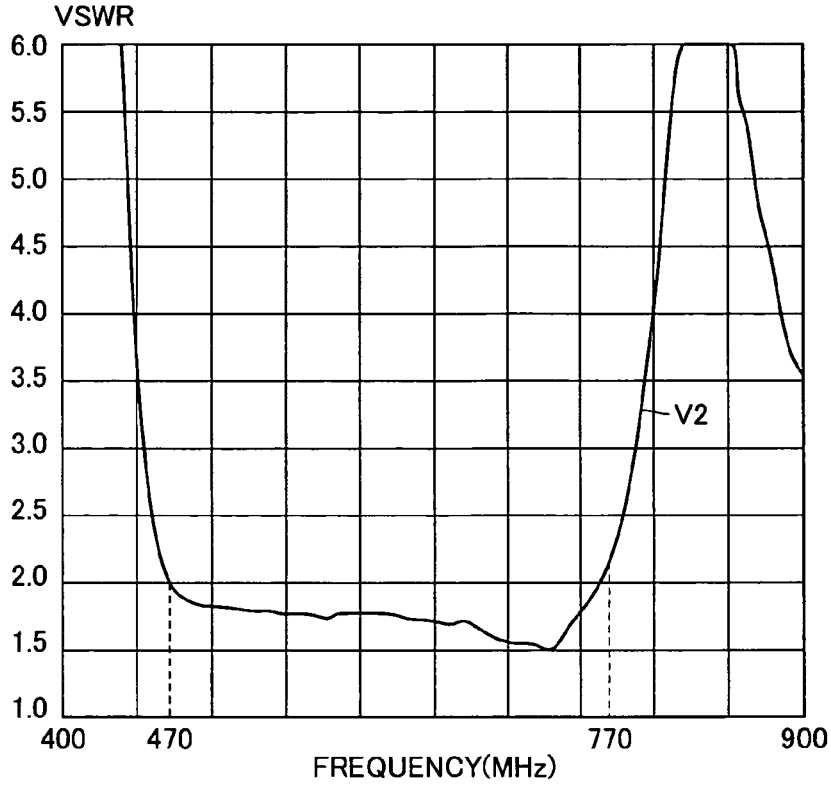
FIG. 9 is a diagram showing another characteristic of antenna apparatus 1 further including directors 16, 17 and reflector 18.

FIG. 9 is a diagram showing another characteristic of antenna apparatus 1 further including directors 16, 17 and reflector 18. Referring to FIG. 9, a curve V2 represents varying VSWR with respect to frequencies. In the frequency range of 470 to 770 MHz, the value of VSWR is approximately 2 or lower.

Figure 10:
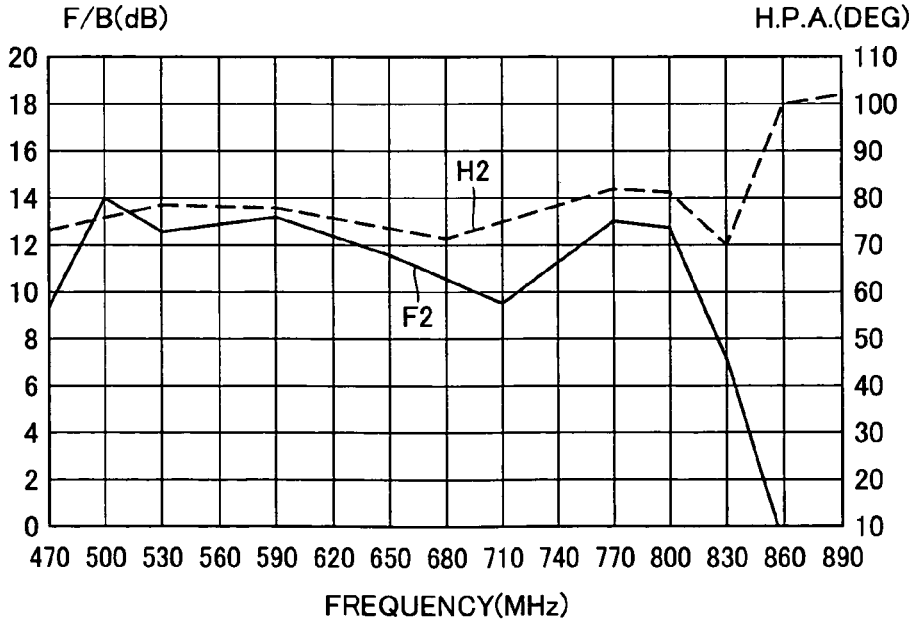
FIG. 10 is a diagram showing yet another characteristic of antenna apparatus 1 further including directors 16, 17 and reflector 18.

FIG. 10 is a diagram showing yet another characteristic of antenna apparatus 1 further including directors 16, 17 and reflector 18. Referring to FIG. 10, a curve F2 represents the varying front-to-back ratio with respect to frequencies. A curve H2 represents the varying half-width with respect to frequencies. Provision of reflector 18 causes the front-to-back ratio, in particular, to vary. In the frequency range of 470 to 770 MHz, the front-to-back ratio varies in the range from about 10 dB to about 14 dB. It is noted that the half-width varies from about 70° to about 80°.

Figure 11:
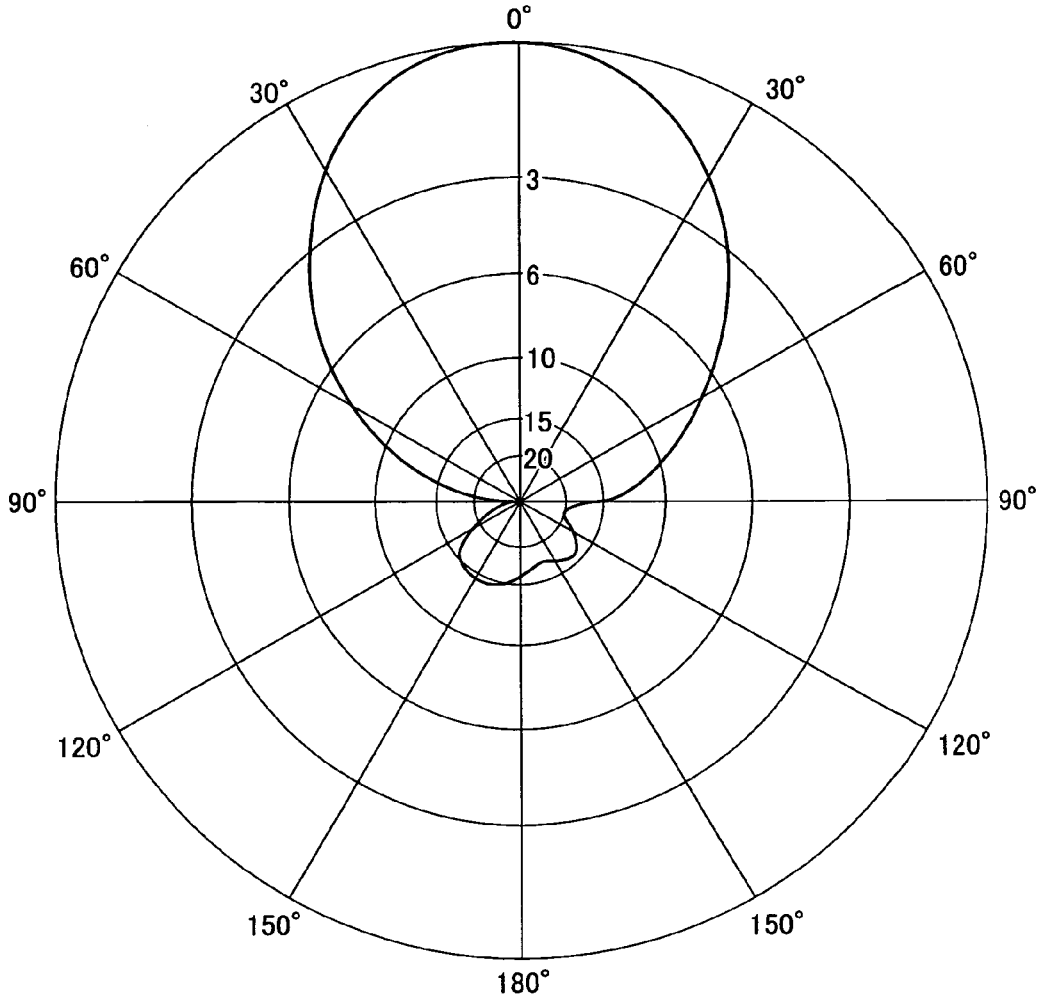
FIG. 11 is a diagram showing a further characteristic of antenna apparatus 1 further including directors 16, 17 and reflector 18.

FIG. 11 is a diagram showing a further characteristic of antenna apparatus 1 further including directors 16, 17 and reflector 18. Referring to FIG. 11, the directivity of antenna apparatus 1 is shown. It is shown that provision of the reflector causes the directivity at the back of antenna apparatus 1 (the range from 120° to 180°) to be weakened.

Now, a modified radiator included in the antenna apparatus of the present invention will be described. As described above, in the antenna apparatus of the present invention, a radiator may include two radiating elements having a symmetrical shape with respect to the Y-axis (the axis along the direction of reception/transmission of electric waves) and a transmission line portion connecting the tip end portions of the two radiating elements to each other. Each of two radiating elements may have at least part of the outer shape formed such that its distance from the Y-axis increases with increasing distance from the midpoint of the line segment joining the mutual feed points along the Y-axis.

Figure 12:
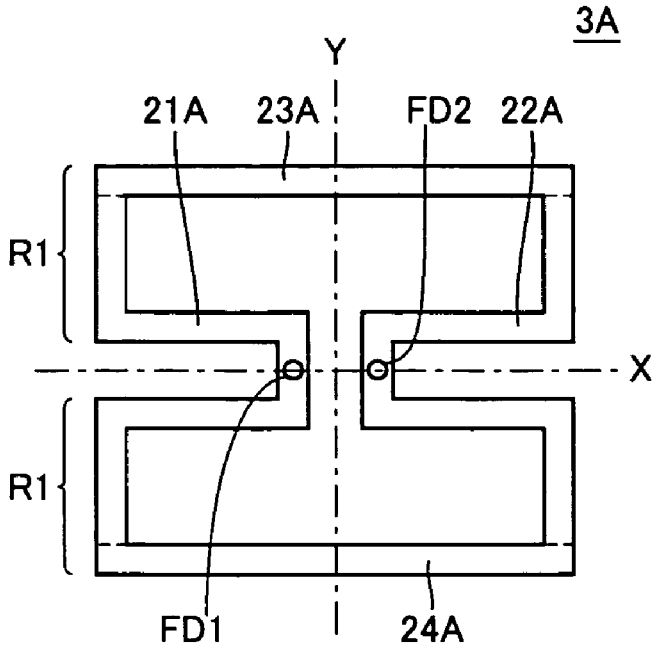
FIG. 12 is a view showing a modification to radiator 3 in FIG. 1.

FIG. 12 is a view showing a modification to radiator 3 in FIG. 1. Referring to FIG. 12, a radiator 3A is symmetrical with respect to both of the X-axis and the Y-axis. It is noted that the X-axis and the Y-axis in FIG. 12 are the same as the X-axis and the Y-axis shown in FIG. 3, respectively. Radiator 3A includes radiating elements 21A, 22A and transmission line portions 23A, 24A. Radiating elements 21A, 22A have feed points FD1, FD2, respectively. Radiating elements 21A, 22A are formed to be bent at a right angle along the X-axis and the Y-axis. It is noted that radiating elements 21A, 22A may be shaped to extend radially from the midpoint of the line segment joining feed points FD1 and FD2 along the Y-axis.

Figure 13:
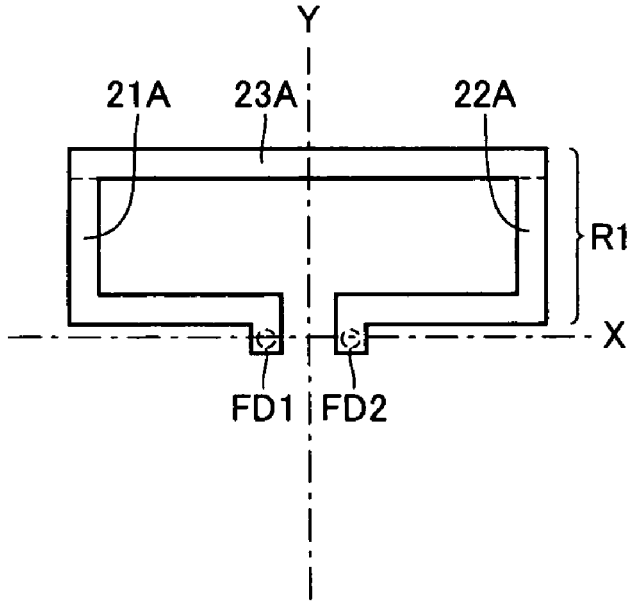
FIG. 13 is a view showing a radiator R1 in FIG. 12.

FIG. 13 is a view showing a radiator R1 in FIG. 12. Referring to FIG. 13, radiator R1 corresponds to a component of radiator 3A. Radiator 3A is formed by combining two radiators R1. It is noted that the X-axis and the Y-axis shown in FIG. 13 are the same as the X-axis and the Y-axis shown in FIG. 3, respectively.

Radiator R1 is symmetrical with respect to the Y-axis. Radiator R1 includes radiating elements 21A, 22A and a transmission line portion 23A. Radiating elements 21A, 22A have feed points FD1, FD2, respectively. Feed points FD1, FD2 of radiator 3A are provided at the middle of the line segment joining feed points FD1, FD2 of two radiators R1 to each other. Alternatively, they are provided at a position where feed points FD1, FD2 of two radiators R1 overlap with each other. It is noted that, similarly to radiator 3A, radiator R1 is also applicable to the antenna apparatus of the present invention.

Figure 14:
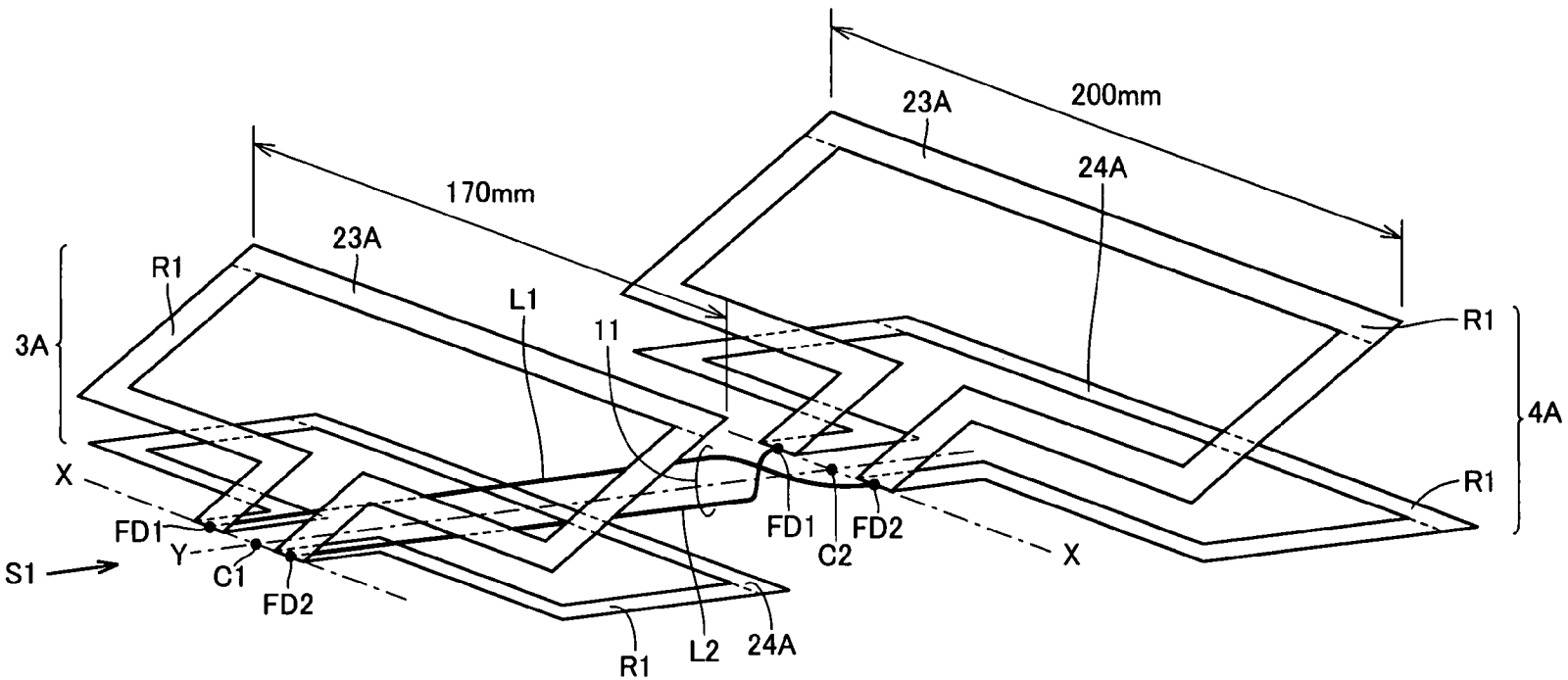
FIG. 14 is a view showing an exemplary arrangement of radiators 3A, 4A in the antenna apparatus in accordance with the present invention.

FIG. 14 is a view showing an exemplary arrangement of radiators 3A, 4A in the antenna apparatus of the present invention. Referring to FIG. 14, radiators 3A, 4A are arranged along the Y-axis direction. The Y-axis shown in FIG. 14 is the axis joining the midpoint C1 of the line segment joining feed points FD1 and FD2 of radiator 3A to the midpoint C2 of the line segment joining feed points FD1 and FD2 of radiator 4A. The direction of the Y-axis is the direction of travel of signal S1. The direction of the X-axis shown in FIG. 14 is the direction of the line segment joining feed points FD1 and FD2 of radiator 3A and also the direction of the line segment joining feed points FD1 and FD2 of radiator 4A. The direction of the X-axis shown in FIG. 14 is the same as the direction of the X-axis shown in FIG. 1.

The shape of radiator 4A is similar to the shape of radiator 3A and therefore the description thereof will not be repeated in the following. Each of radiators 3A, 4A is formed such that the distance from the plane including the X-axis and the Y-axis (XY plane) increases with increasing distance from the midpoint (midpoint C1 or midpoint C2) of the line segment joining feed points FD1 and FD2 along the Y-axis. In short, each of radiators 3A, 4A is bent along the line segment joining feed points FD1 and FD2. Antenna apparatus 1 can be reduced in thickness by bending radiators 3A, 4A in this way.

As shown in FIG. 1, feeder line 11 includes transmission lines L1, L2. Transmission line L1 connects feed point FD1 of radiator 3A to feed point FD2 of radiator 4A. Transmission line L2 connects feed point FD2 of radiator 3A to feed point FD1 of radiator 4A.

The dimensions (in particular, the length in the X-axis direction) of radiators 3A, 4A are appropriately determined according to the characteristics of an antenna. In the example shown in FIG. 14, the length in the X-axis direction of radiator 3A, that is, the length of transmission line portion 23A (the length of transmission line portion 24A) is about 170 mm (about 0.35λ of the center frequency). Furthermore, the length in the X-axis direction of radiator 4A, that is, the length of transmission line portion 23A (the length of transmission line portion 24A) is about 200 mm (about 0.4λ of the center frequency). The length in the X-axis direction of each of radiators 3A, 4A is set in this way, so that signal S1 can efficiently be received. It is noted that the lengths in the X-axis direction of radiators 3A, 4A may be equal to each other.

Figure 15:
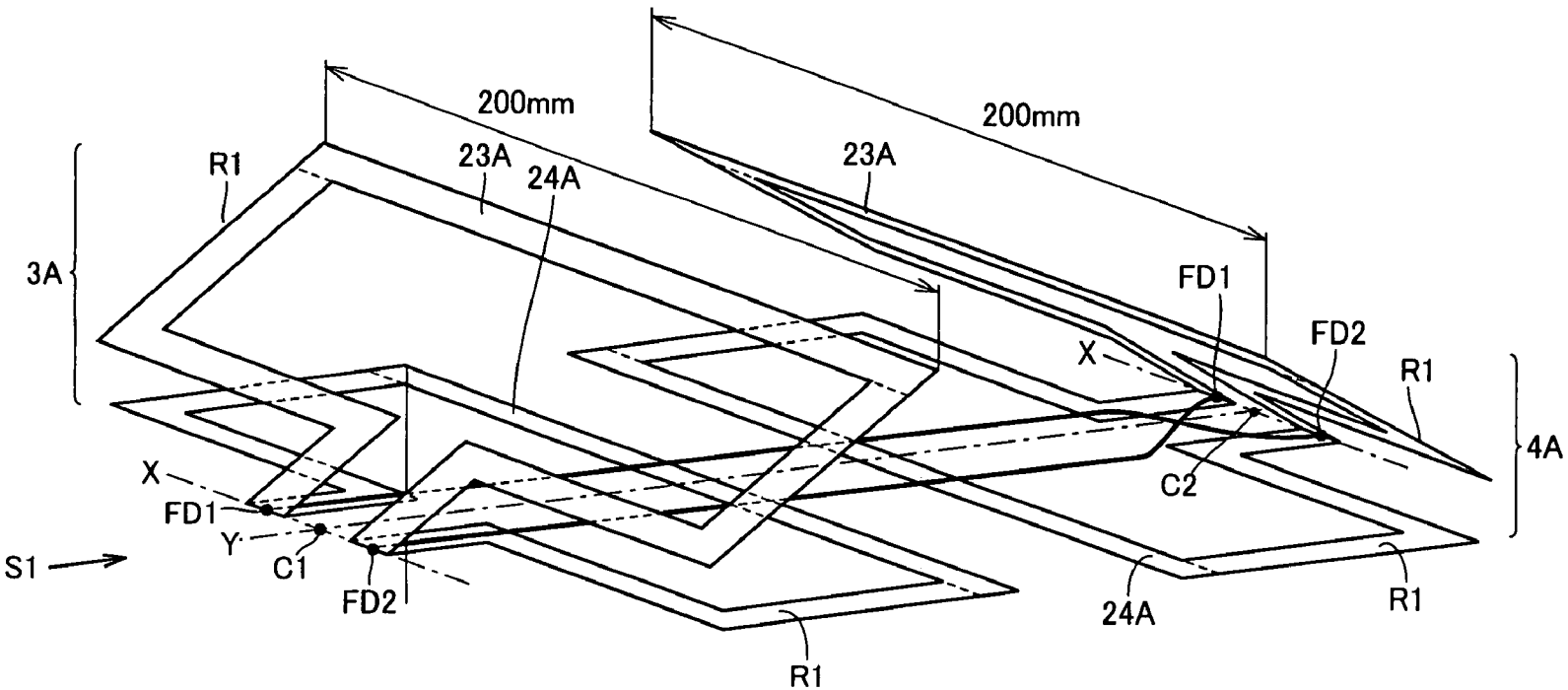
FIG. 15 is a view showing another arrangement of radiators 3A, 4A shown in FIG. 14.

FIG. 15 is a diagram showing another arrangement of radiators 3A, 4A shown in FIG. 14. Referring to FIG. 15, the arrangement of radiators 3A, 4A in FIG. 15 differs from that of FIG. 14 in that radiator 4A shown in FIG. 14 rotates by 180° in the XY plane. Also in this case, transmission line L1 connects feed point FD1 of radiator 3A to feed point FD2 of radiator 4A, and transmission line L2 connects feed point FD2 of radiator 3A to feed point FD1 of radiator 4A. In the example of FIG. 15, the length in the X-axis direction of radiator 3A (the length of transmission line portion 23A and the length of transmission line portion 24A) is set at 200 mm. It is noted that as shown in FIG. 14 the length in the X-axis direction of radiator 4A may be longer than the length in the X-axis direction of radiator 3A.

Alternatively, as another modification to the arrangement of radiators 3A, 4A shown in FIG. 15, radiator 3A may rotate by 180° in the XY plane.

As described above, in accordance with the first embodiment, two radiators arranged along the reception/transmission direction of electric waves (the Y-axis) are included. Each of two radiators includes two radiating elements, each having a shape symmetrical with respect to the Y-axis and having at least part of the outer shape formed such that the distance increases in the X-axis direction, and a transmission line portion connecting the tip ends of the radiating elements. Therefore, in accordance with the first embodiment, the antenna apparatus can be miniaturized with improved characteristics.

Moreover, in accordance with the first embodiment, the characteristics can be improved as compared with the conventional miniature antenna by feeding two radiators with a phase difference.

In addition, in accordance with the first embodiment, the characteristics can be improved by providing a director and a reflector.

Second Embodiment

Figure 16:
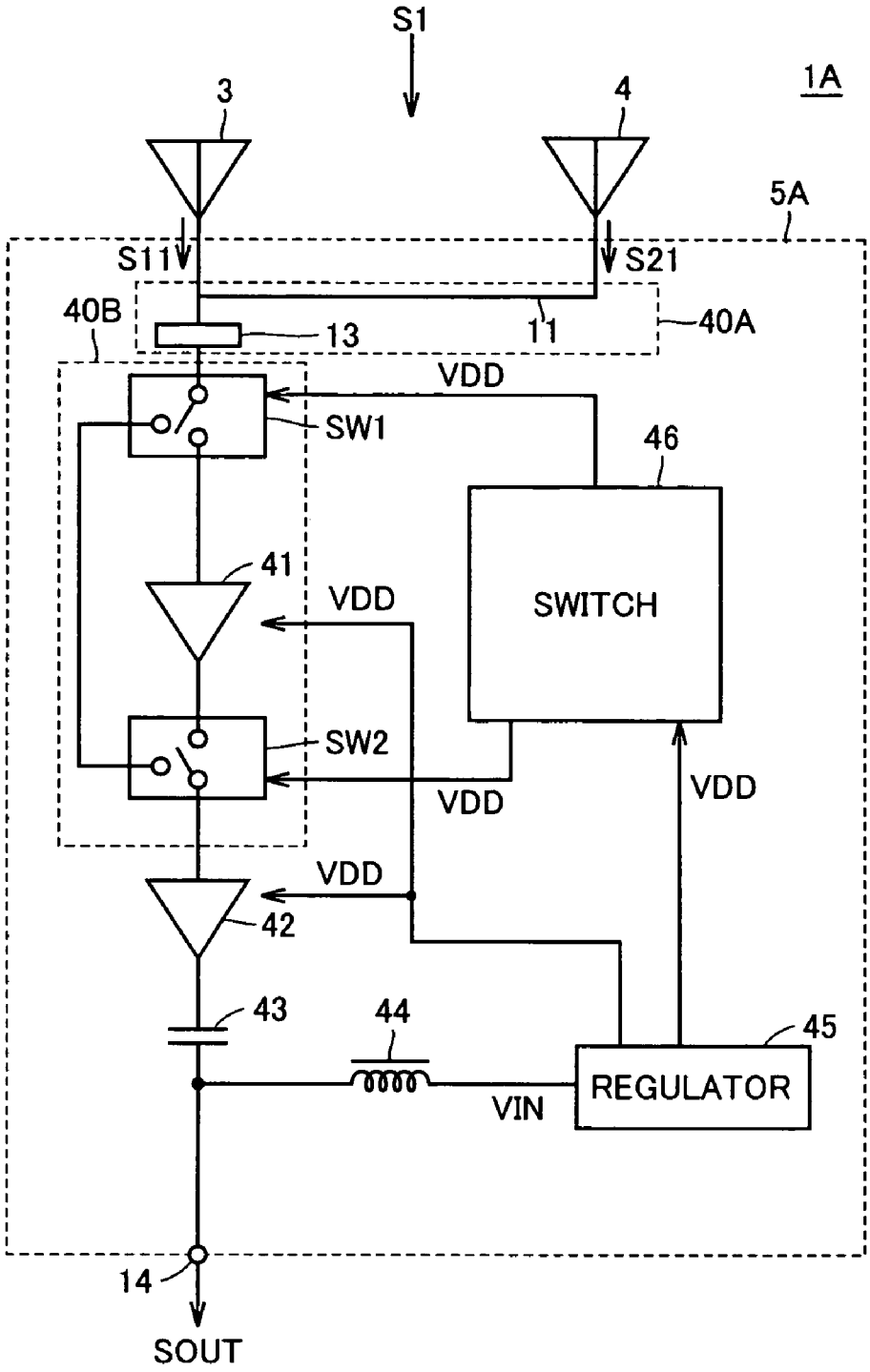
FIG. 16 is an overall block diagram of an antenna apparatus in a second embodiment.

FIG. 16 is an overall block diagram of an antenna apparatus in accordance with a second embodiment. Referring to FIG. 16, an antenna apparatus 1A differs from antenna apparatus 1 shown in FIG. 1 in that feed portion 5 is replaced by a feed portion 5A. The configuration of the other parts is similar to that of antenna apparatus 1 and therefore the description thereof will not be repeated in the following.

Feed portion 5A includes a combination portion 40A, an amplification portion 40B, an amplifier 42, a capacitor 43, a choke coil 44, a regulator 45, and a switch 46.

Combination portion 40A includes a feeder line 11 and a balun 13. Combination portion 40A corrects a phase difference between signals S11 and S21 output from radiators 3, 4, respectively, in response to receiving signal S1 to combine signals S11 and S21.

Amplification portion 40B amplifies an output from combination portion 40A. Provision of amplification portion 40B allows CN ratio (Carrier to Noise Ratio) to improve even when a power loss is caused by a feed line such as a feeder line or a coaxial cable.

Amplification portion 40B includes switches SW1, SW2 and an amplifier 41. Each of switches SW1, SW2 switches connection depending on whether a voltage VDD is input from switch 46. Switches SW1, SW2 switch whether the output from combination portion 40A is sent to amplifier 41 or amplifier 42 not through amplifier 41. In other words, amplification portion 40B can switch whether or not the output from combination portion 40A is amplified.

When switch SW1 is connected to the input of amplifier 41 and switch SW2 is connected to the output of amplifier 41, a signal output from balun 13 is amplified by amplifier 41. By switching the connection of switches SW1, SW2, the signal output from balun 13 is directly sent to amplifier 42. A signal SOUT output from amplifier 42 is sent, for example, to a receiving apparatus such as a television receiver.

Capacitor 43 and choke coil 44 are provided to supply a voltage VIN to regulator 45. Regulator 45 is supplied with voltage VIN through connector 14, for example, from a power inserter. It is noted that regulator 45 may be supplied with voltage VIN from a power source (not shown).

Regulator 45 outputs a voltage VDD in response to an input of voltage VIN. Voltage VDD is a power supply voltage of amplifier 41 and amplifier 42.

Switch 46 is provided to switch whether or not voltage VDD output from regulator 45 is supplied to switches SW1, SW2. Switch 46 is for example a manual switch. Depending on a reception condition of signal S1 at the installation location of antenna apparatus 1A, the operator switches switch 46 when antenna apparatus 1A is installed, so that it can be switched whether or not voltage VDD is supplied to switches SW1, SW2. Therefore, when the received signal strength of signal S1 is weak, the output from combination portion 40A is amplified by amplifier 41, resulting in excellent CN ratio. It is noted that switch 46 may be formed of a switching device such as a transistor.

Figure 17:
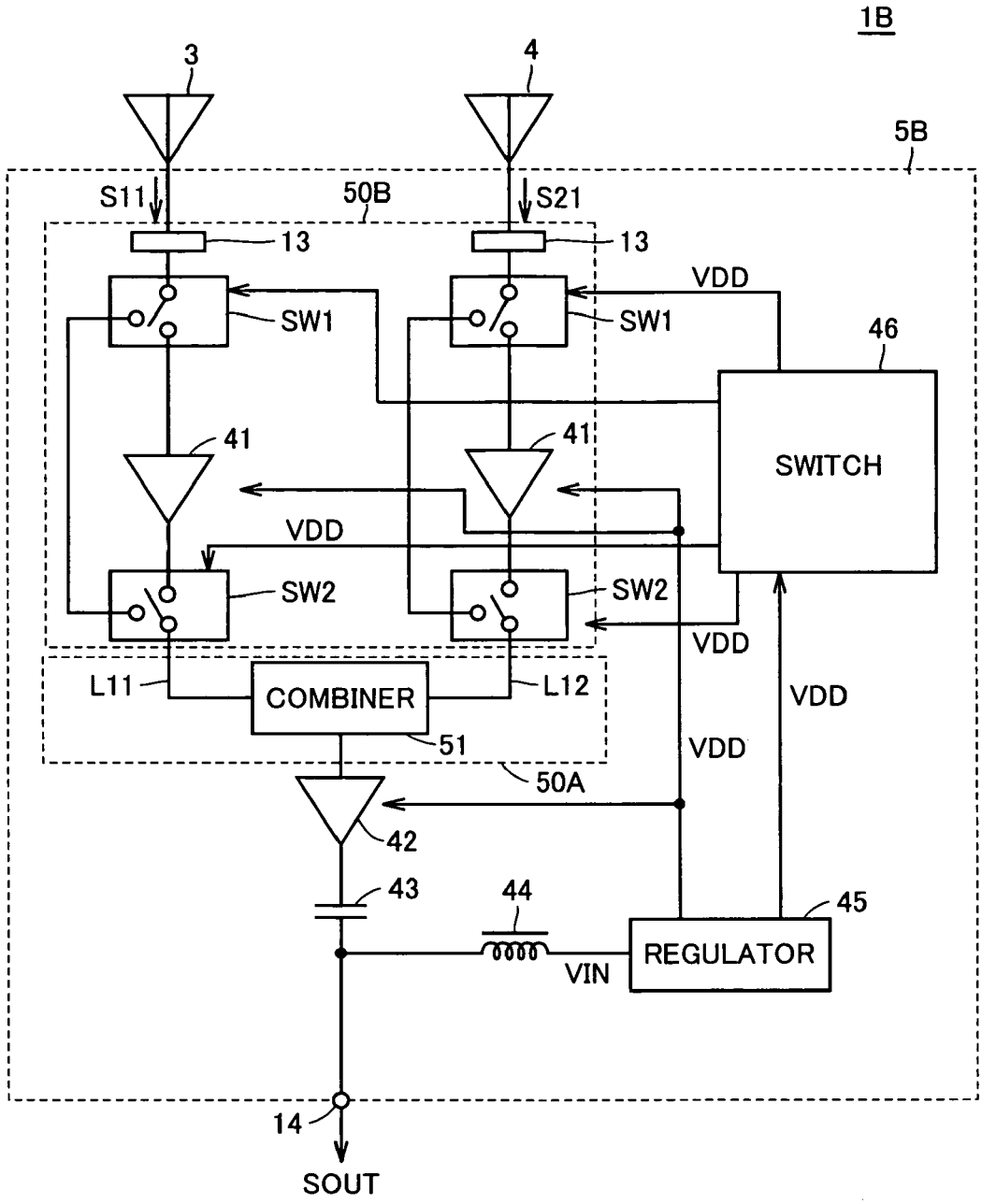
FIG. 17 is a diagram showing a modification to the second embodiment.

FIG. 17 is a diagram showing a modification to the second embodiment. Referring to FIG. 17, an antenna apparatus 1B differs from antenna apparatus 1A shown in FIG. 15 in that feed portion 5A is replaced by a feed portion 5B. The configuration of the other parts is similar and therefore the description thereof will not be repeated in the following.

Feed portion 5B differs from feed portion 5A in that combination portion 40A and amplification portion 40B are replaced by a combination portion 50A and an amplification portion 50B. The configuration of the other parts is similar to that of feed portion 5A and therefore the description thereof will not be repeated in the following.

Amplification portion 50B amplifies each of signals S11, S21 for output. Combination portion 50A corrects a phase difference between signals S11 and S21 amplified by amplification portion 50B to combine signals S11 and S21.

Amplification portion 50B differs from amplification portion 40B in that it includes balun 13, switches SW1, SW2, and amplifier 41 provided for each of radiators 3, 4. Two switches SW1 and two switches SW2 switch the connection depending on whether voltage VDD is input.

Combination portion 50A includes a transmission line L11, a transmission line L12, and a combiner 51 combining and outputting signals transmitted through each of transmission lines L11, L12.

Transmission lines L11, L12 are formed, for example, of coaxial cables. Transmission line L11 transmits a signal output from switch SW2 provided for radiator 3. Transmission line L12 transmits a signal output from switch SW2 provided for radiator 4. The length of transmission line L11 differs from the length of transmission line L12 so that radiators 3, 4 can be fed with a phase difference. It is noted that the length of each of transmission lines L11, L12 is for example about 90 mm (about 0.2λ of the center frequency).

As described above, in accordance with the second embodiment, an amplification portion that amplifies an output of a radiator is provided, so that CN ratio of a signal output from the antenna apparatus can be improved.

In addition, in accordance with the second embodiment, it can be switched whether or not an output from a radiator is amplified in an amplification portion depending on a reception condition of electric waves.

Third Embodiment

The overall configuration of an antenna apparatus in a third embodiment is similar to that of antenna apparatus 1 shown in FIG. 1. It is noted that a radiator included in the antenna apparatus in the third embodiment differs in shape from radiators 3, 4 included in antenna apparatus 1 in FIG. 1. The antenna apparatus in the third embodiment has the configuration similar to antenna apparatus 1 in FIG. 1 except that radiators 3, 4 are replaced by radiators 3B, 4B. In the following, referring to FIG. 18, the shape of radiator 3B included in the antenna apparatus in the third embodiment will be described. It is noted that radiator 4B has a shape similar to radiator 3B and therefore the description of the shape of radiator 4B will not be repeated in the following.

Figure 18:
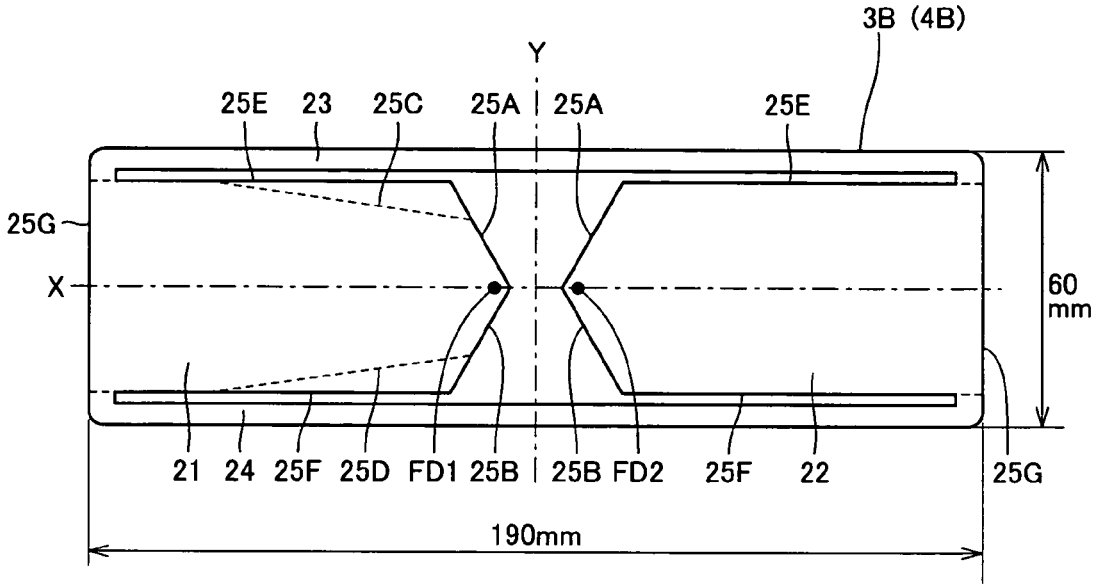
FIG. 18 is a view showing a shape of a radiator included in an antenna apparatus in a third embodiment.

FIG. 18 is a view showing the shape of radiator 3B included in the antenna apparatus in the third embodiment.

Referring to FIG. 18, radiator 3B differs from radiator 3 in FIG. 3 in the shape of radiating elements 21, 22. Each of radiating elements 21, 22 is in the shape of a pentagon including sides 25A, 25B, 25E, 25F, 25G (the first to fifth sides). The other part of radiator 3B is similar to that of radiator 3 and therefore the description thereof will not be repeated in the following.

Sides 25E and 25F are parallel to the X-axis (the second axis). One end of side 25E is connected to side 25A. One end of side 25F is connected to side 25B. Side 25G is vertical to the X-axis. One end and the other end of side 25G are connected to the other end of side 25E and the other end of side 25F, respectively.

As compared with radiator 3, in radiator 3B, each of radiating elements 21, 22 does not include sides 25C, 25D. Therefore, the area of the radiating element can be larger in radiator 3B than in radiator 3. Therefore, as described later, the antenna apparatus in the third embodiment has improved characteristics as compared with the first embodiment.

In addition, radiating elements 21, 22 and transmission line portions 23, 24 are integrally formed like a plate, for example, by stamping out a metal plate using a die. Therefore, the antenna apparatus in the third embodiment allows reduction of manufacturing costs. It is noted that radiators 3, 4 in FIG. 1 may also be integrally formed like a plate similar to radiator 3B.

Figure 19:
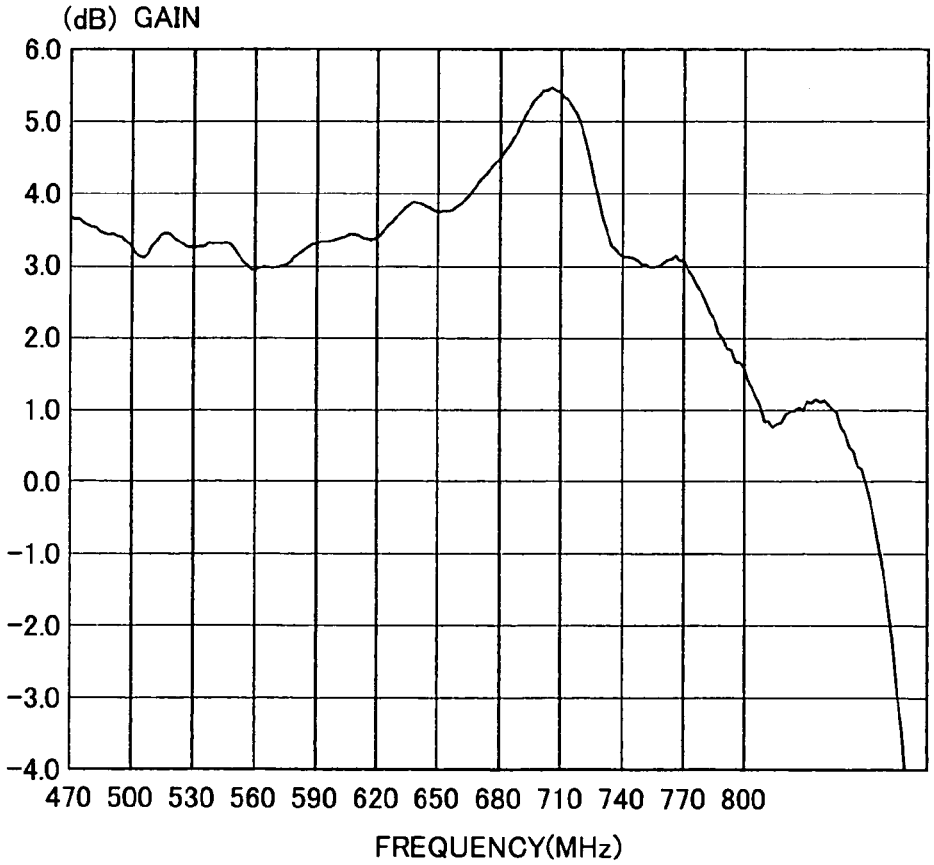
FIG. 19 is a diagram showing the gain of the antenna apparatus in the third embodiment.
Figure 20:
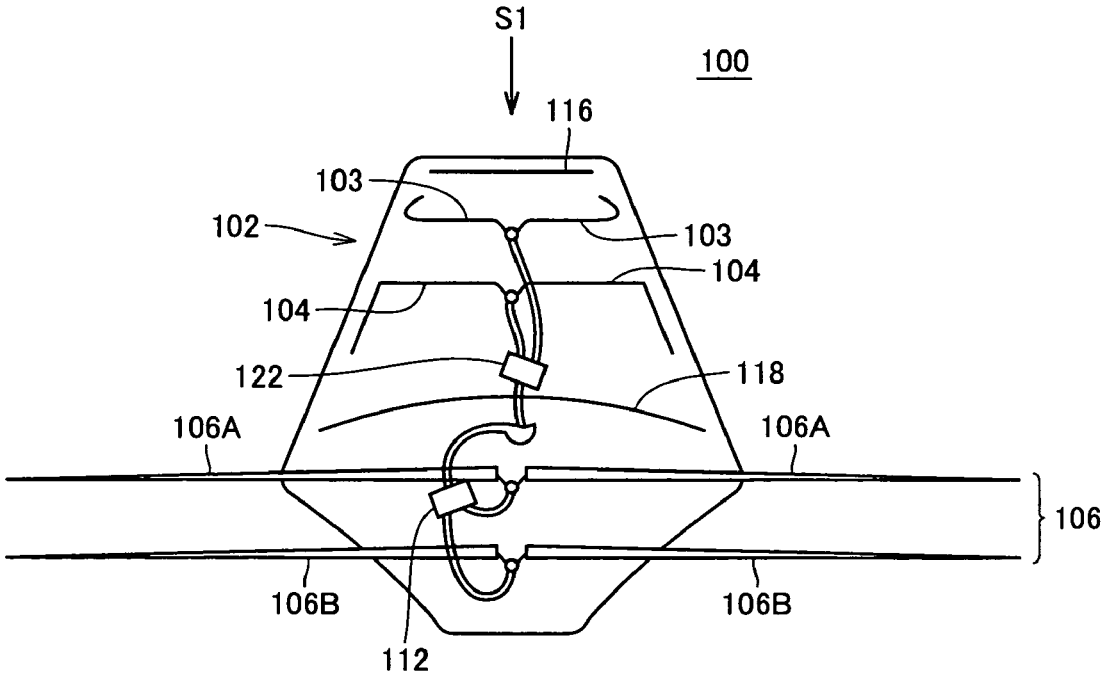
FIG.20 PRIOR ART
FIG. 20 is a view showing an exemplary conventional miniature antenna.

FIG. 19 is a diagram showing the gain of the antenna apparatus in the third embodiment. It is noted that FIG. 19 is contrasted with FIG. 8. Referring to FIG. 19, the gain at 770 MHz is about 3.0 dB. As shown in FIG. 8, the gain of the antenna apparatus in the first embodiment is below 3.0 dB at 770 MHz. Furthermore, the peak value of the gain (the gain in the vicinity of 710 MHz) is about 5.5 dB in FIG. 19, while the peak value of the gain in FIG. 8 is about 5.0 dB. As described above, the antenna apparatus in the third embodiment has its characteristics improved by increasing the area of the radiating element as compared with the first embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna apparatus comprising first and second radiators arranged in parallel along a prescribed direction, said first and second radiators each including a first radiating element, and a second radiating element arranged symmetrically to said first radiating element with respect to a first axis along said prescribed direction; wherein said first and second radiating elements are provided in such a manner that a midpoint of a line segment extending between a feed point of said first radiating element and a feed point of said second radiating element is positioned on said first axis, and each of said first radiating element and said second radiating element has at least part of an outer shape formed such that a distance from said first axis to the part increases as a distance from said midpoint along said first axis increases, and said first and second radiating elements each further include a first transmission line portion provided on one side of opposing sides with respect to a second axis overlapping said line segment to connect tip end portions of said first and second radiating elements to each other.

2. The antenna apparatus according to claim 1, wherein said first and second radiating elements each have a shape symmetrical with respect to said second axis, and said first and second radiating elements each further include a second transmission line portion provided on a side opposite to said first transmission line portion with respect to said second axis to connect tip end portions of said first and second radiating elements to each other.

3. The antenna apparatus according to claim 2, wherein said first and second radiating elements each have a shape of a polygon, and said polygon is symmetrical with respect to said second axis and has first and second sides formed such that a distance from said first axis to first side and a distance from said first axis to second side increase as a distance from said midpoint along said first axis increases.

4. The antenna apparatus according to claim 3, wherein said polygon is a pentagon further having third, fourth and fifth sides, said third and fourth sides are parallel to said second axis, one end of said third side is connected to said first side, one end of said fourth side is connected to said second side, and one end and the other end of said fifth side are connected to the other end of said third side and the other end of said fourth side, respectively.

5. The antenna apparatus according to claim 2, wherein said first and second radiating elements and said first and second transmission line portions each are formed such that a distance from a plane including said first and second axes increases as a distance from said midpoint along said first axis increases.

6. The antenna apparatus according to claim 2, wherein said first and second radiating elements and said first and second transmission line portions are integrally formed like a plate.

7. The antenna apparatus according to claim 1, further comprising a feed portion feeding each of said first and second radiators such that first and second output signals respectively output from said first and second radiators have a same phase, in response to receiving electric waves traveling along said prescribed direction.

8. The antenna apparatus according to claim 7, further comprising at least one of a director and a reflector.

9. The antenna apparatus according to claim 7, wherein said feed portion includes a first feed line connecting said first radiating element included in said first radiator to said second radiating element included in said second radiator, and a second feed line connecting said second radiating element included in said first radiator to said first radiating element included in said second radiator, and a length of each of said first and second feed lines is determined according to a phase difference between said first and second output signals.

10. The antenna apparatus according to claim 7, wherein said feed portion includes a combination portion correcting a phase difference between said first and second output signals to combine said first and second output signals, and an amplification portion amplifying an output from said combination portion.

11. The antenna apparatus according to claim 10, wherein said amplification portion can switch whether or not the output from said combination portion is amplified.

12. The antenna apparatus according to claim 7, wherein said feed portion includes an amplification portion amplifying said first and second output signals, and a combination portion correcting a phase difference between said first and second output signals amplified by said amplification portion to combine said first and second output signals.

13. The antenna apparatus according to claim 12, wherein said amplification portion can switch whether or not said first and second output signals are amplified.

14. The antenna apparatus according to claim 1, further comprising a housing accommodating said first and second radiators.

* * * * *